US009078502B2

(12) United States Patent
Fily et al.

(10) Patent No.: US 9,078,502 B2
(45) Date of Patent: Jul. 14, 2015

(54) CLOSURE FOR POUCHES

(75) Inventors: Sébastien Lucien Fily, Ville Mont-Royal (CA); Bruno Chazel, Cran Gévrier (FR)

(73) Assignee: Bayer Consumer Care AG, Basel (CH)

( * ) Notice: Subject to any disclaimer, the term of this patent is extended or adjusted under 35 U.S.C. 154(b) by 584 days.

(21) Appl. No.: 13/134,833

(22) Filed: Jun. 17, 2011

(65) Prior Publication Data

US 2012/0102890 A1 May 3, 2012

(30) Foreign Application Priority Data

Dec. 18, 2008 (EP) ..... 08291210

(51) Int. Cl.

| | |
|---|---|
| ***B65B 7/00*** | (2006.01) |
| ***B65D 45/00*** | (2006.01) |
| ***A45C 13/14*** | (2006.01) |
| ***B65D 33/16*** | (2006.01) |
| ***B65D 33/14*** | (2006.01) |

(52) U.S. Cl.

CPC ..... *A45C 13/14* (2013.01); *B65D 33/14* (2013.01); *B65D 33/1666* (2013.01)

(58) Field of Classification Search

CPC .... B65B 51/04; B65B 43/123; B65B 51/023; B65B 9/15; B65B 13/34; B65B 25/065; B65D 33/14; B65D 33/30; B65D 33/1625; B65D 33/1641; B65D 33/1616; B65D 33/1666; B65D 33/1675; B65D 45/16; B65D 45/20; B65D 45/22; B65D 63/10; B65D 63/12; B65D 63/1027; B65D 63/1081; B65D 67/06; B65D 77/185

USPC ..... 53/469, 478, 481, 417, 138.1, 138.2, 53/138.3; 220/315; 383/63, 69, 61.2, 89, 383/90, 82, 83, 88; 24/30.5 R, 30.5 W, 24/30.5 P, 30.5 S, 30.5 T, 30.5 L, 537, 587, 24/588, 46–462

See application file for complete search history.

(56) References Cited

U.S. PATENT DOCUMENTS

| | | | | | |
|---|---|---|---|---|---|
| 1,361,605 | A | * | 12/1920 | Morrill | 383/69 |
| 3,141,221 | A | * | 7/1964 | Faulls, Jr. | 24/30.5 R |
| 3,266,711 | A | * | 8/1966 | Song | 383/13 |
| 3,481,007 | A | * | 12/1969 | Scarritt, Jr. | 24/30.5 L |
| 5,050,272 | A | * | 9/1991 | Robinson et al. | 24/30.5 R |
| D331,364 | S | * | 12/1992 | Barker et al. | D9/434 |
| 5,379,489 | A | * | 1/1995 | Delk et al. | 24/30.5 R |
| D372,674 | S | * | 8/1996 | Weber et al. | D9/443 |
| 5,613,282 | A | * | 3/1997 | Deddens et al. | 24/30.5 R |
| 5,619,775 | A | * | 4/1997 | Klinck | 24/30.5 R |
| 5,713,108 | A | * | 2/1998 | Solomon et al. | 24/30.5 R |
| 5,913,456 | A | * | 6/1999 | Dikeman | 222/95 |
| 5,983,460 | A | * | 11/1999 | Hyde et al. | 24/30.5 R |
| 7,503,696 | B2 | * | 3/2009 | Ha et al. | 383/69 |
| 2003/0188510 | A1 | * | 10/2003 | Vargas | 53/410 |
| 2005/0050853 | A1 | * | 3/2005 | Byron et al. | 53/416 |

* cited by examiner

*Primary Examiner* — Hemant M Desai
(74) *Attorney, Agent, or Firm* — Thomas C. Blankinship

(57) ABSTRACT

A closure for a pouch comprising: (a) a cylindrical sleeve having a first open end and a second open end, (b) a longitudinal slit in the cylindrical sleeve having a close end proximate to the first end of the cylindrical sleeve and an open end at the second end of the cylindrical sleeve; (c) a rod adapted to be arranged concentrically within the cylindrical sleeve having a first end and a second end, the first end of the rod being adapted to engage with the first end of the cylindrical sleeve; and (d) a child-proof lock adapted to be removably connected to the second end of the cylindrical sleeve or to the second end of the rod to block the open end of the longitudinal slit.

20 Claims, 11 Drawing Sheets

CLOSURE FOR POUCHES

BACKGROUND OF THE INVENTION

1. Field of the Invention

The invention relates to a reusable closure with a child-resistant or child-proof lock for pouches, sachets or bags and to methods for closing such pouches, sachets or bags.

2. Description of Related Art

Re-closable pouches are widely known, for example from PCT Publication No. WO 98/057,863 to Bois, published Dec. 23, 1998, and PCT Publication No. WO 2004/103,827 to Dais et al., published Dec. 2, 2004 (also published as U.S. Publication No. 2004/0,234,173 to Saad et al., on Nov. 25, 2004). The closure of these pouches is based on male and female closure elements on two opposite internal surfaces of the pouch. Some re-closable pouches use more sophisticated systems, like internal gripping sliders as disclosed for example in PCT Patent Publication No. WO 2002/008,078 to Tomic, published Jan. 31, 2002 (also issued as U.S. Pat. No. 6,290,393 on Sep. 18, 2001). PCT Patent Publication No. WO 2006/058,418 to Bondy, published Jun. 8, 2006, discloses a re-closable pouch having additional security closing device functions. U.S. Pat. No. 5,681,115 to Diederich et al., issued Oct. 28, 1997, discloses a child-resistant locking device for a re-closable pouch including a zipper operatively associated with the opening and movable between an open and closed position. The zipper is provided with a pull tab having an opening for actuating the zipper and a releasable lock supported on the pouch operatively associated with the pull tab opening for releasably retaining the zipper in the closed position. The lock includes elements requiring manual dexterity with both hands at a skill level common to an adult as opposed to a child for release. All these re-closable bags are not necessarily airtight and therefore do not reliably protect the content from degradation because of atmospheric aggressions.

Daesung Hi-tech Ltd. Co., a Korean company, offers devices over the Internet for airtight re-closing of pouches under the trademarks Anylock™, Coolock™, and Carrylock™ (www.mirbong.co.kr and www.anylock.co.kr). These closures comprise a cylindrical sleeve having open ends and a longitudinal slit forming an opening into the circumferential wall of the cylindrical sleeve. The longitudinal slit extends from one end, the feeding end, of the cylindrical sleeve until shortly before the other end, the stopper end, of the cylindrical sleeve end thereby forming a close end of the slit. The closure further comprises a rod which is longer than the cylindrical sleeve and adapted to be arranged concentrically within the cylindrical sleeve. One end of the rod, the blocker end, is broadened, such that upon inserting the other end, the free end, of the rod into the stopper end of the cylindrical sleeve the forward movement of the rod will be stopped when the blocker end of the rod engages the stopper end of the cylindrical sleeve. In this position the free end of the rod projects out of the feeding end of the cylindrical sleeve.

The Daesung device requires the pouch to be folded over and closed so the walls of the pouch form a kink. With one side this kink is slid into the feeding end of the cylindrical sleeve and moved forward along the longitudinal direction of the cylindrical sleeve to the stopper end of the cylindrical sleeve such that the folded parts of the walls proximate to the kink are arranged between the rod and the inner wall of the cylindrical sleeve. With this arrangement of the closure the pouch is closed. The pouch can be re-opened by sliding the closure from the folded pouch in the opposite direction such that the kink is moved away form the stopper end of the cylindrical sleeve. These closures can be used for any type of pouch with appropriate size.

Even though the Daesung device purports to be airtight, it may not always prove to be airtight in actual use. In addition, if the content of the pouch is a pharmaceutical, a cleaning agent or another substance which should not end up in the hands of children, the pouch should not be easily re-opened for safety reasons.

SUMMARY OF THE INVENTION

The principal object of the invention therefore is to provide a closure for pouches that cannot be opened by children and that is sealed tightly enough to protect the materials contained in the pouches from atmospheric degradation.

Another object of the invention is to provide methods for sealing a pouch and a method for re-opening the pouch when desired.

Additional objects and advantages of the invention will be set forth in part in the description that follows, and in part will be obvious from this description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the invention provides a closure for a pouch comprising a cylindrical sleeve having a first open end and a second open end; a longitudinal slit in the cylindrical sleeve having a closed end proximate to the first open end of the cylindrical sleeve and an open end at the second open end of the cylindrical sleeve; a rod adapted to be arranged concentrically within the cylindrical sleeve having a first rod end and a second rod end, said first rod end being adapted to engage with the first open end of the cylindrical sleeve; and a removable lock, proximate to and removably engaged with the second end of the cylindrical sleeve, second rod end of the rod, or both, thereby blocking the open end of the longitudinal slit.

The invention further provides a method for enclosing a material in the child-proof pouch.

The invention further provides a method for re-opening the pouch once it has been sealed.

DETAILED DESCRIPTION OF THE PREFERRED EMBODIMENTS OF THE INVENTION

Figure 1:
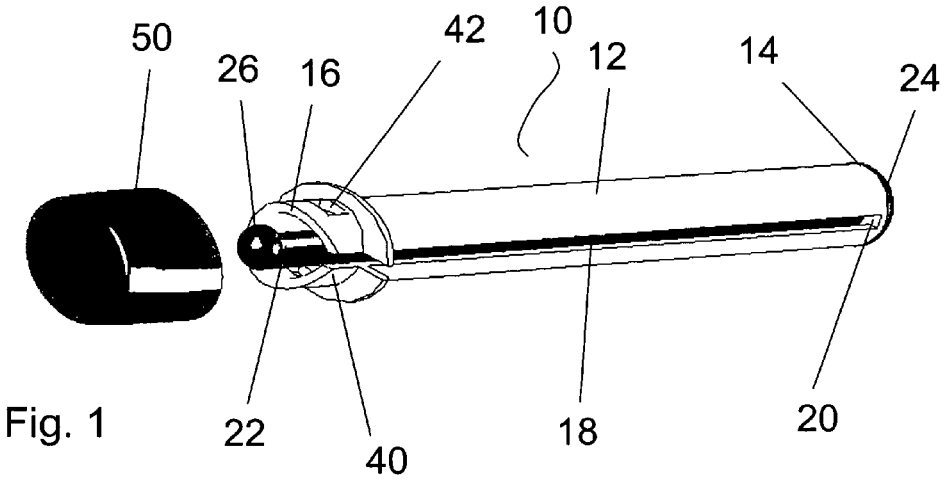
FIG. 1 shows a perspective view of the closure and the cap of the invention.
Figure 2A:
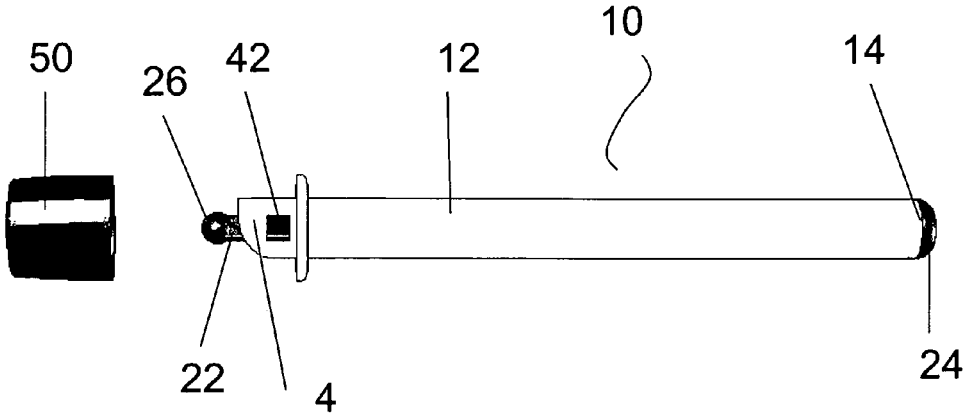
FIGS. 2*a* and 2*b* show first and second side views of the closure and the cap of the invention.
Figure 2B:
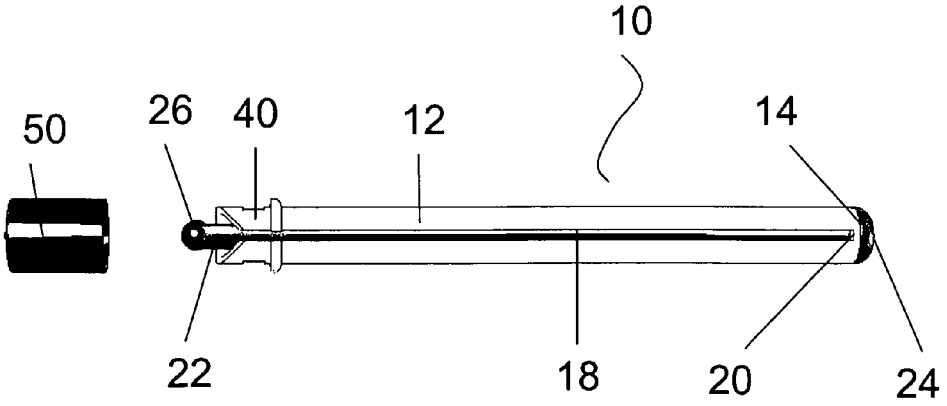
Figure 3:
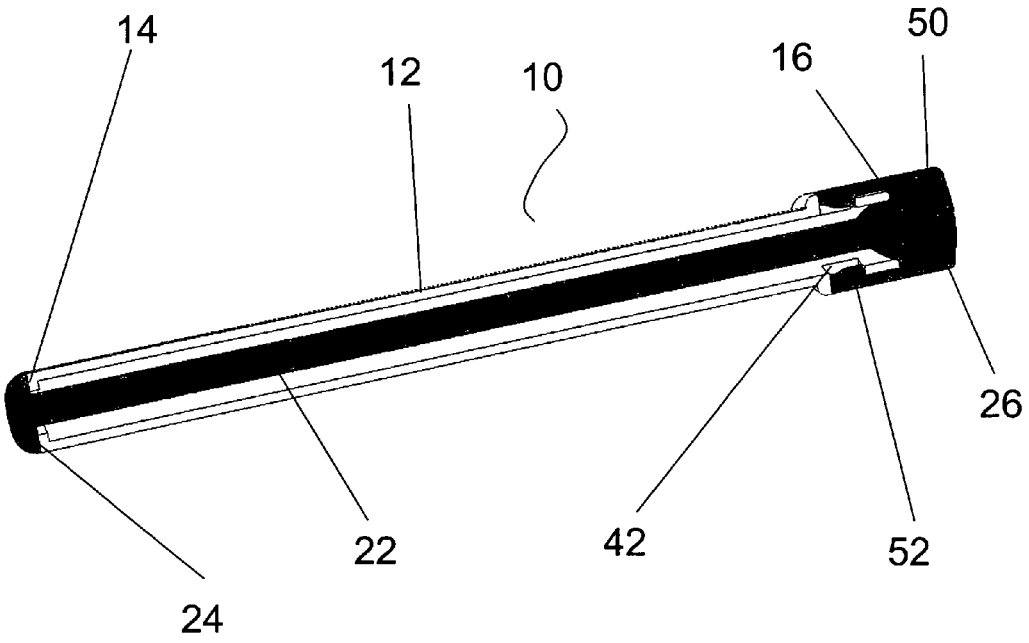
FIG. 3 shows a cross-sectional view of the closure of the invention with a cap connected to the cylindrical sleeve of the invention.
Figure 4:
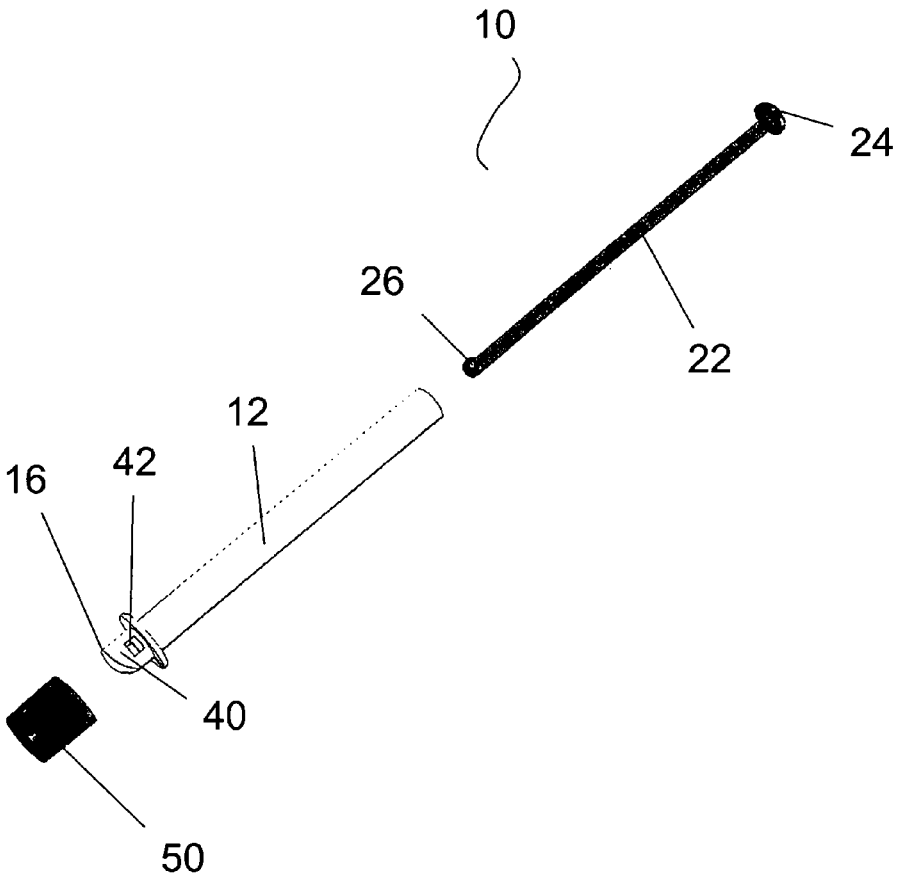
FIG. 4 shows the rod, cylindrical sleeve and cap of the invention.

The invention provides a closure for a pouch and methods to close and re-open the pouch. As used herein, the term "pouch" includes any kind of container capable of holding any kind of material. The container should have a flexible end comprising an opening or mouth for inserting and removing the material. The container may be fully flexible or may be partially rigid, and should be made from suitable ingredients so that the materials inside the container are not degraded or adversely affected by the pouch. Acceptable containers include, but are not limited to, pouches, sachets and bags.

The closure of the invention comprises a cylindrical sleeve having: a first open end (the stopper end), a second open end (the feeding end), and a longitudinal slit. The longitudinal slit has a closed end proximate to the first open end (stopper end) of the cylindrical sleeve, and an open end at the second open end (feeding end) of the cylindrical sleeve. The closure also has a rod adapted to be arranged concentrically within the cylindrical sleeve. The rod has a first rod end (the blocker end) and a second rod end (the free end). The first rod end (blocker end) is adapted to engage with the first open end (stopper end) of the cylindrical sleeve, and a child-proof lock is adapted to be removably connected to either the second rod end (the free end) or to an end portion proximate the second end (feeding end) of the cylindrical sleeve or to both, thereby blocking the open end of the longitudinal slit.

To seal a pouch, the walls of the pouch near the opening or mouth are inserted into the cylindrical sleeve and are pinched together between the interior of the cylindrical sleeve and the rod at an area between the opening or mouth of the pouch and the material in the pouch, thereby isolating the material from the outer environment.

Preferably the rod is at least as long as the cylindrical sleeve. Preferably the cylindrical sleeve and the rod can be fabricated as a unitary piece, in which case the first open end (stopper end) of the sleeve and the first rod end (blocker end) of the rod would be different portions of a unitary region on the integrated device. In another embodiment, the rod and sleeve may be fabricated as two separate parts that are then joined in any conventional manner at the first rod end (blocker end) and the first open end (stopper end). In another preferred embodiment of the invention, the rod and sleeve may remain as separate items. The first open end (stopper end) and the first rod end (blocker end) would then be designed to cooperate to block off access to the interior of the sleeve through that end of the closure.

The cylindrical sleeve can have any length, depending on the size of the pouch to be closed, but a preferred length is from about 40 mm to about 300 mm, more preferably from about 50 mm to about 200 mm. The outer diameter of the cylindrical sleeve can also be any size, depending on the thickness of the pouch walls that are to be pinched together, but a preferred diameter is from about 5 mm to about 50 mm.

The rod can have a circular, square, triangular or n-angled (where n=5, 6, 7, 8, or more) cross-section. The walls of the rod between the angles can be flat or cambered. The maximum outer diameter of the rod is preferably in the range between 1 to 30 mm. The surface of the rod can be structured or patterned to increase the grip of the rod on the walls of the pouch. An angled shape of the cross-section of the rod also serves to improve the grip of the rod on the walls of the pouch in the closure and therefore can improve the sealing of the pouch.

The child-proof lock comprises a ring, a cap or a bar connected to the feeding end of the cylindrical sleeve or to the free end of the rod (or both) and blocks the open end of the longitudinal slit. The ring, cap or bar can be only removed after performing a specific action requiring a minimum force or skills which i.e. children usually do not possess. As long as the ring, cap or bar is connected to the cylindrical sleeve or to the rod the closed pouch cannot be re-opened, because the open end of the longitudinal slit is blocked and the closure cannot be slid off the folded pouch.

The ring, cap or bar can have a patterned or structured surface to facilitate gripping. The length of the ring or cap in longitudinal direction is preferably in the range of from about 5 mm to about 50 mm, more preferably in the range of from about 15 mm to about 40 mm.

The cylindrical sleeve, the rod and the cap, ring or bar can be made of a rigid material such as plastic, aluminum, steel or wood. The cap can be also made of a flexible material to allow the squeeze-and-turn opening for child resistance.

The folded end portion of the pouch can have a hole and can be turned around the cylindrical sleeve of the closure such that the folded end portion forms a hanger for the pouch. Alternatively the closure can have a hanger portion connected to or forming one part with the cylindrical sleeve. The hanger portion can have a hole for mounting.

In one embodiment the feeding end portion of the cylindrical sleeve has two slots or apertures on opposite sides. The cap has an elliptical cross-section and two protrusions on its inner walls in the area of the endpoints of the minor axis of the elliptical cross-section. The protrusions correspond to the apertures or slots in the feeding end portion of the cylindrical sleeve. The closure is locked upon engagement of the protrusions of the cap with apertures or slots in the feeding end portion of the cylindrical sleeve.

The closure can be re-opened by pressing on the two opposite areas at the exterior of the wall of the cap where the endpoints of the major axis of the elliptical cross-section are located. Upon this pressure the cap walls in the areas of the endpoints of the minor axis of the elliptical cross-section move axially away from each other thereby lifting the protrusions from the apertures or slots and the cap or ring can be removed from the feeding end portion of the cylindrical sleeve. After removal of the cap or ring the pouch can be re-opened by sliding the closure from the folded pouch in the opposite direction away form the stopper end of the cylindrical sleeve.

In one embodiment the child-proof lock comprises a color coding to differentiate different contents of the pouch being closed i.e. different drugs or different dosages of the same drug.

Preferred embodiments of the invention may be better understood with reference to the drawings.

FIGS. 1 to 4 show a closure 10 for a pouch with a cylindrical sleeve 12 having open ends 14, 16 and a longitudinal slit 18 forming an opening in the circumferential wall of the cylindrical sleeve 12. Longitudinal slit 18 extends from the feeding end 16 of the cylindrical sleeve 12 until shortly before the stopper end 14 thereby forming a closed end 20 of the slit 18. A rod 22 is arranged concentrically within the cylindrical sleeve 12. The blocker end 24 of rod 22 is broadened, such that upon inserting the free end 26 of the rod 22 into the stopper end 14 of the cylindrical sleeve 12 the forward movement of the rod 22 will be stopped when the blocker end 24 of the rod 22 engages the stopper end 14 of the cylindrical sleeve 12. In this position the free end 26 of the rod 22 projects out of the feeding end 16 of the cylindrical sleeve 12.

In one embodiment the blocker end 24 and the stopper end 14 are permanently interconnected, either by means of glue or ultrasonic welding.

In a preferred embodiment, the cylindrical sleeve 12 and the rod 22 are made as one part. In this case (not shown) the longitudinal slit 18 may extend from the feeding end 16 to the stopper end 14 of the cylindrical sleeve 12 since the broadened part of the rod 22 will block the open end of the slit 18 at the stopper end 14.

Figure 5:
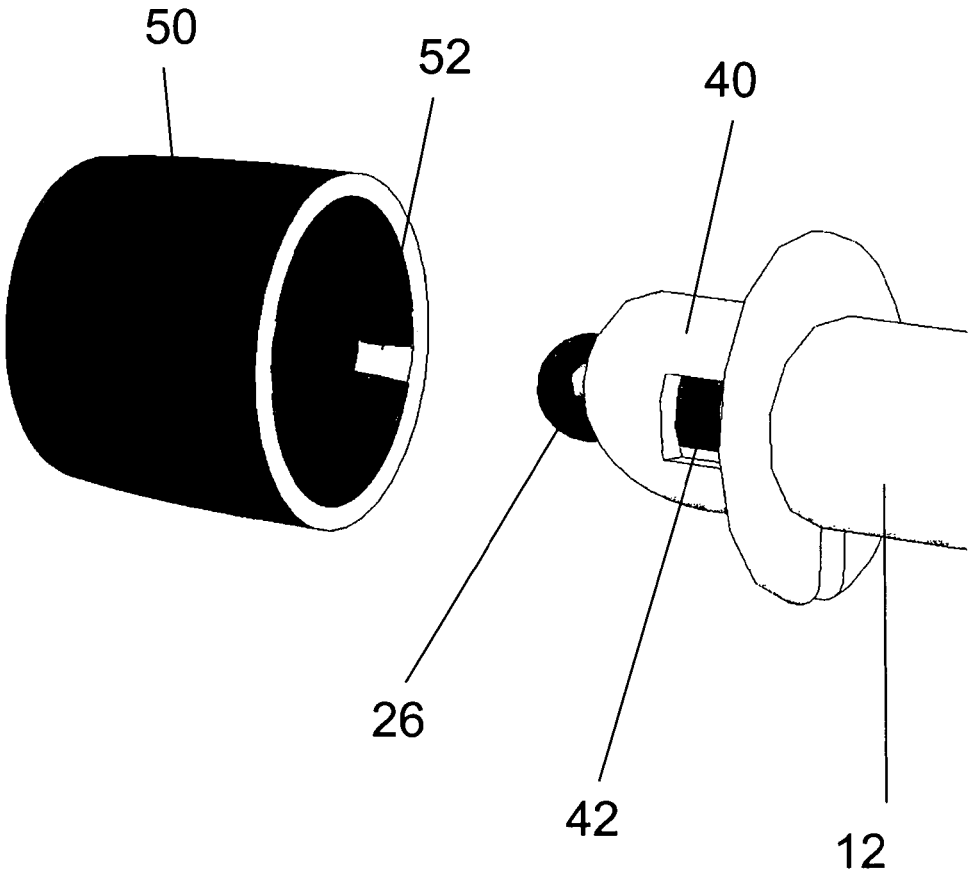
FIG. 5 shows an enlarged view of an embodiment of the invention in which the cap is secured to the rod closure by at least one protrusion and aperture.

As shown enlarged in FIG. 5 the feeding end portion 40 of the cylindrical sleeve 12 has two apertures 42 on opposite sides. The cap 50 has an elliptical cross-section and two protrusions 52 on its inner walls in the area of the endpoints of the minor axis of the elliptical cross-section. The protrusions 52 correspond to apertures 42. The closure 10 is locked upon engagement of the protrusions 52 of the cap 50 with apertures 42 in the feeding end portion 40 of the cylindrical sleeve 12 (see FIG. 3).

Figure 6A:
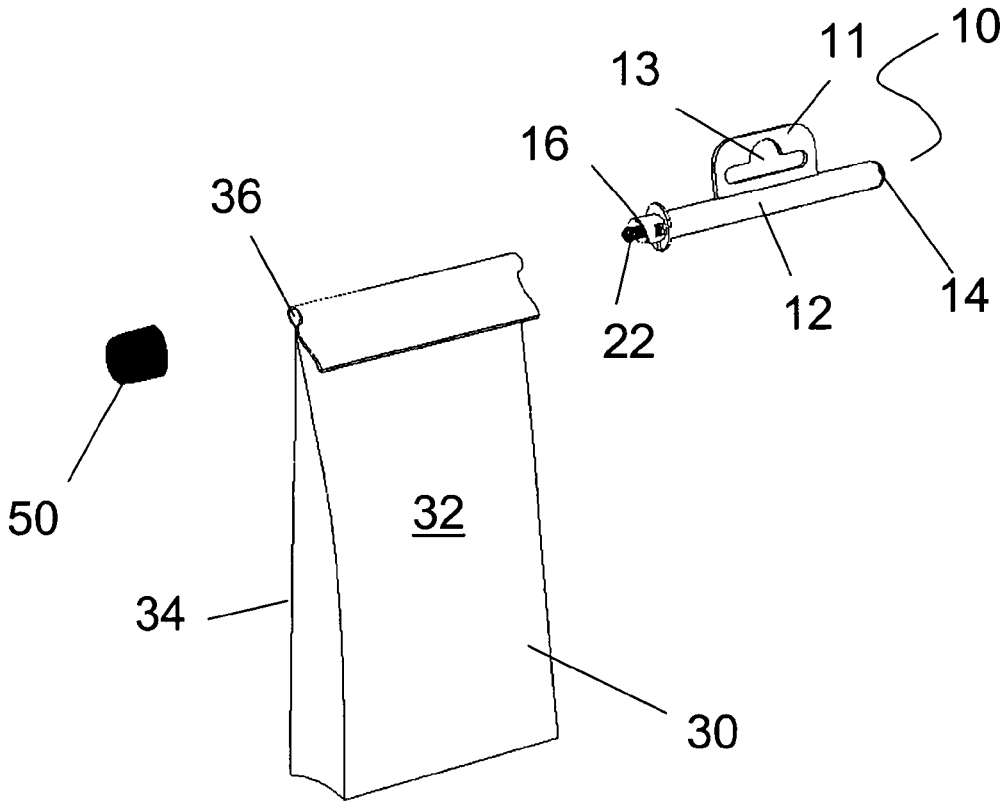
FIGS. 6*a-d* show how the closure is attached to a pouch and locked.
Figure 6B:
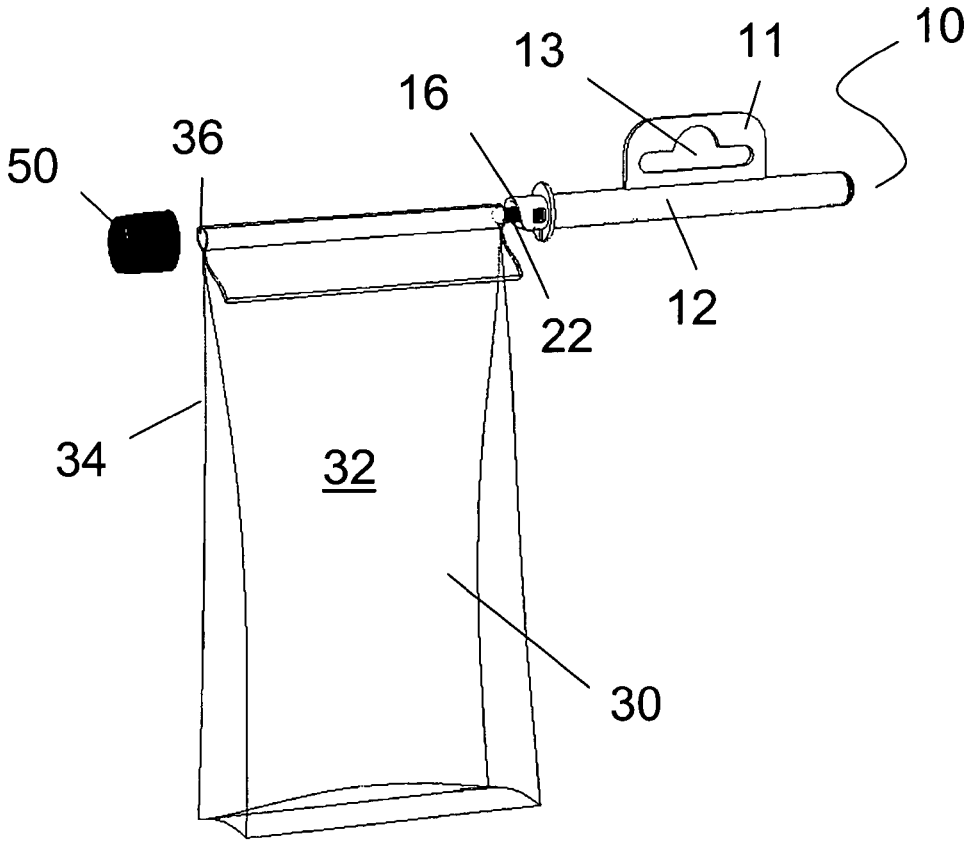
Figure 6C:
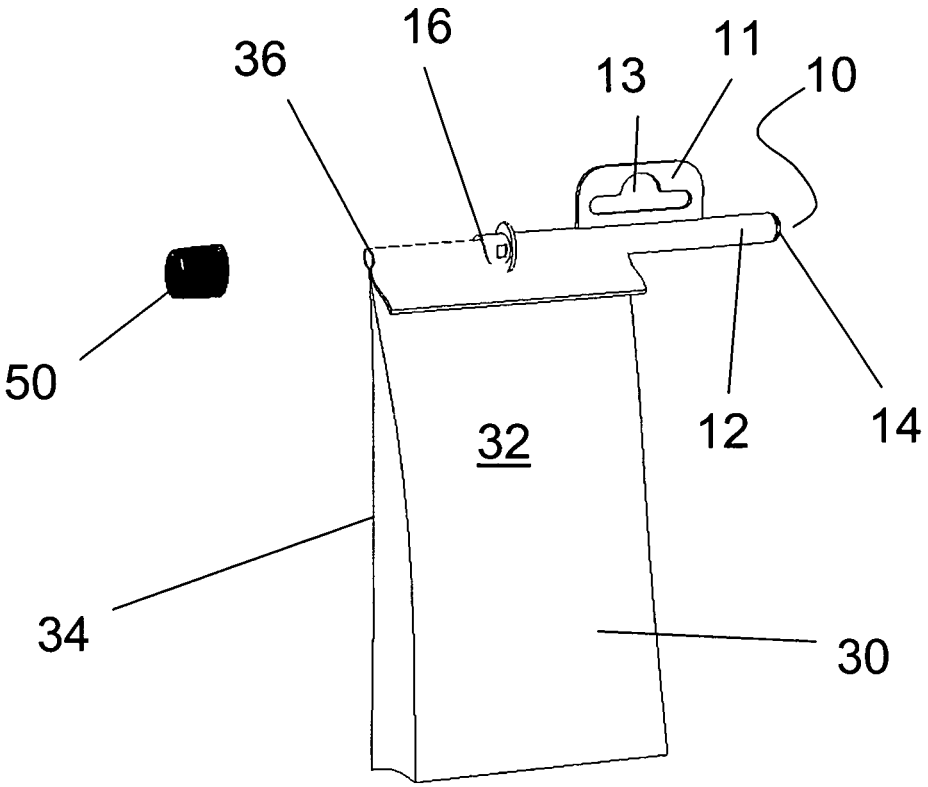
Figure 6D:
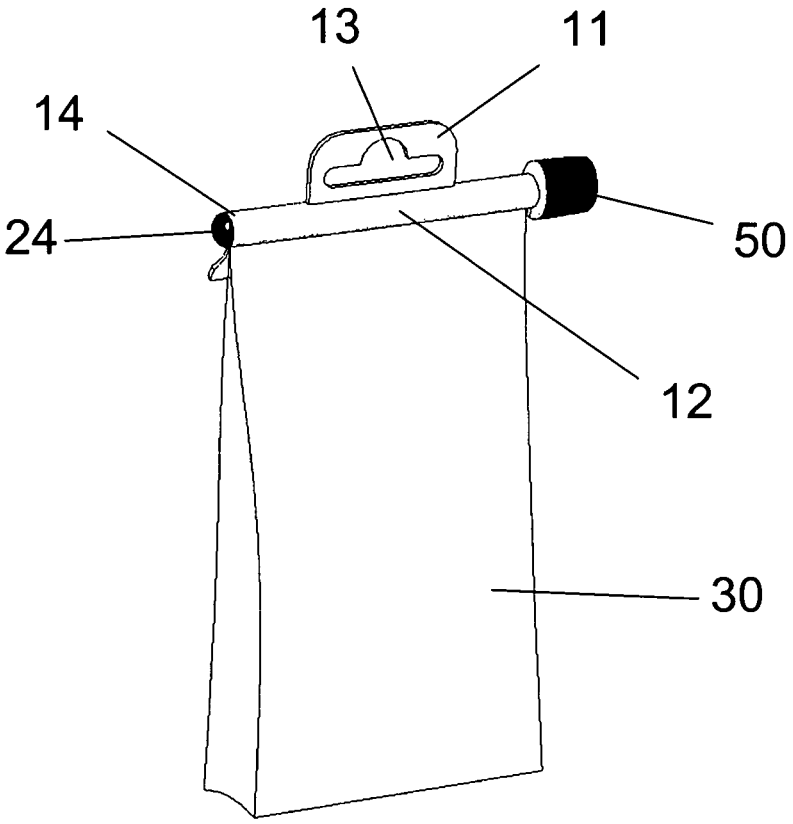

FIGS. 6*a-d* show how the closure 10 is attached to a pouch 30. The closure 10 has a hanger portion 11 with a hole 13. The pouch 30 is folded over such that the walls 32, 34 of the pouch 30 form a channel 36. Starting with one side this channel 36 is arranged around the rod 22 and slid into the feeding end 16 of the cylindrical sleeve 12 and moved forward in longitudinal direction of the cylindrical sleeve 12 until the side of the channel 36 engages the stopper end 14 of the cylindrical sleeve 12. When the closure 10 is fully attached to the pouch 30 (FIG. 6*d*) the folded parts of the walls 32, 34 proximate to the channel 36 are arranged between the rod 22 and the inner wall of the cylindrical sleeve 12. The inside diameter of the cylindrical sleeve 12, the external diameter of the rod 22 and the width of the longitudinal slit 18 are adjusted such that, when the closure 10 is attached to the pouch 30, the pouch is tightly closed. The closure 10 is locked upon attaching cap 50 to the feeding end portion 40 of the cylindrical sleeve 12 (see FIG. 6*d* showing the pouch also from the opposite side). The closed pouch 30 can be mounted via the hanger portion 11.

The closure 10 can be re-opened by pressing on the two opposite areas which are located about 90° away from the cap protrusions at the exterior of the wall of the cap 50. Upon this pressure the cap walls in the areas next to the cap protrusions move axially away from each other thereby lifting the protrusions 52 from the apertures 42 and the cap 50 can be removed from the feeding end portion 40 of the cylindrical sleeve 12. After removal of the cap 50 the pouch 30 can be re-opened by sliding the closure 10 from the folded pouch 30 in the opposite direction away form the stopper end 14 of the cylindrical sleeve 12.

Figure 7A:
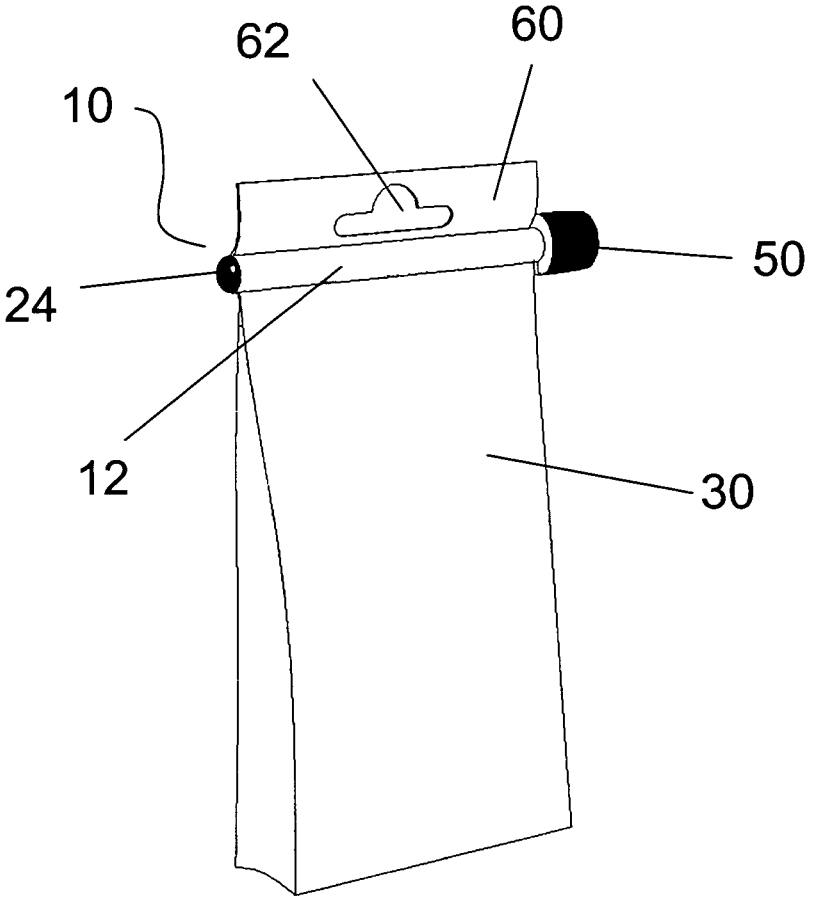
FIGS. 7(*a*) and 7(*b*) show a pouch having both a closure and hanger.
Figure 7B:
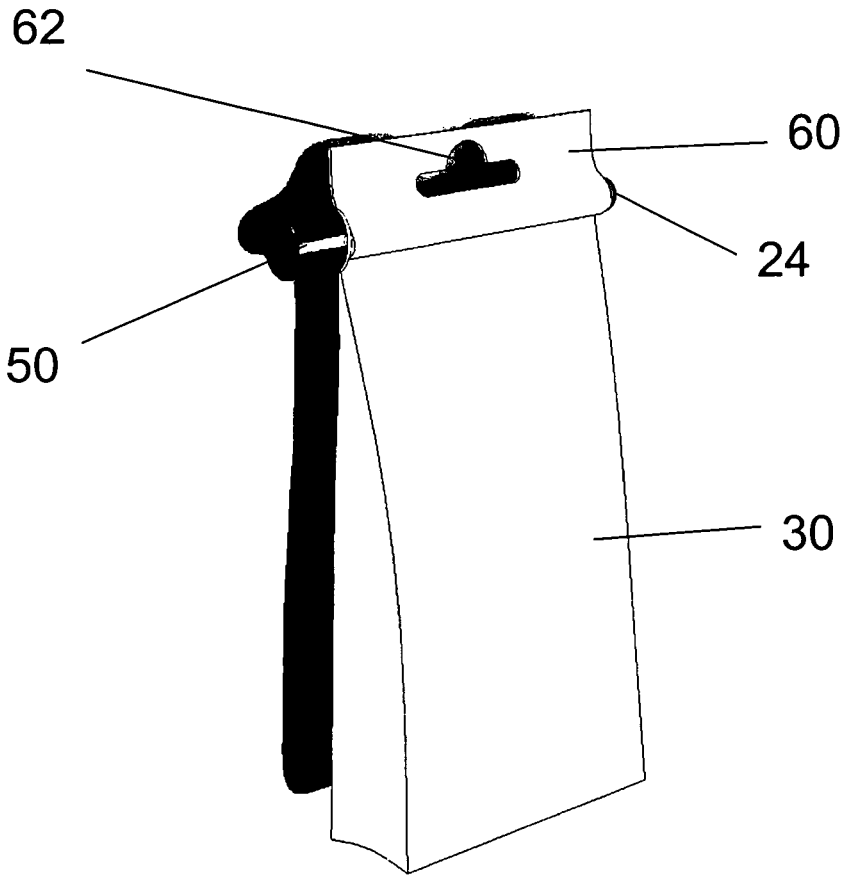

FIGS. 7*a* and 7*b* show an alternative embodiment to the one described previously. FIGS. 7*a* and 7*b* show a pouch (30) with closure (10) and hanger from two opposite sides. The closure 10 is attached to the pouch 30. The folded end portion 60 of the pouch 30 has a hole 62 and is turned around the cylindrical sleeve 12 of the closure such that the folded end portion 60 forms a hanger for the pouch 30.

Although the invention has been described as comprising a child-proof lock or a child-proof pouch, those skilled in the art will understand that these terms are to be construed to include child-resistant locks and child-resistant pouches.

The purpose of the above description is to illustrate some embodiments of the present invention without implying a limitation. It will apparent to those skilled in the art that various modifications and variations may be made in the apparatus or procedure of the invention without departing from the scope or spirit of the invention.

What is claimed is:

1. A closure for a pouch comprising:

(a) a cylindrical sleeve having a first open end and a second open end;

(b) a longitudinal slit in said cylindrical sleeve having a close end proximate to said first open end of said cylindrical sleeve and an open end at said second open end of said cylindrical sleeve;

(c) a rod adapted to be arranged concentrically within said cylindrical sleeve having a first rod end and a second rod end, said first rod end being adapted to engage with said first open end of said cylindrical sleeve; and (d) a removable lock comprising a ring or cap proximate to and removably engaged with said second end of said cylindrical sleeve and locked there in a child-proof manner and blocking said open end of said longitudinal slit.

2. The closure of claim 1, wherein said cylindrical sleeve and said rod comprise a unitary body.

3. The closure of claim 2, wherein said cylindrical sleeve and said rod comprise separate parts that have been permanently interconnected to form said unitary body.

4. The closure of claim 1, wherein said rod is at least as long as said cylindrical sleeve.

5. The closure of claim 1, wherein the-first rod end is broadened compared to the rest of said rod, thereby stopping the movement of said rod in the direction of said second open end of said cylindrical sleeve when said first rod end engages said first open end of said cylindrical sleeve.

6. The closure of claim 1, wherein said rod has a cross-section that is selected from the group consisting of circular, square, triangular and n-angled polygons, wherein n may be an integer greater than or equal to 5, and wherein the walls of said rod are flat or cambered between the angles of said polygon.

7. The closure of claim 1, wherein the maximum outer diameter of said rod is from about 1 to about 30 mm.

8. The closure of claim 1, wherein said closure further comprises a hanger portion connected to or forming one part with said cylindrical sleeve.

9. A method for enclosing a material in a child-proof pouch comprising the steps of:

(a) providing a flexible pouch having a mouth at one end;

(b) inserting said material into said pouch through said mouth;

(c) providing a closure for said pouch comprising a cylindrical sleeve having a first open end and a second open end; a longitudinal slit in said cylindrical sleeve having a closed end proximate to the first open end of the cylindrical sleeve and an open end at the second open end of the cylindrical sleeve; a rod adapted to be arranged concentrically within the cylindrical sleeve, said rod having a first end and a second end, the first end of said rod being adapted to engage with the first end of said cylindrical sleeve; and a removable lock comprising a ring or cap proximate to and removably engaged with the second open end of said cylindrical sleeve or to the second end of said rod and blocking the open end of said longitudinal slit;

(d) folding the end of said pouch comprising said mouth so that the walls of said pouch proximate said mouth form a channel;

(e) aligning said channel so that said channel fits entirely within said cylindrical sleeve surrounding said rod; and (f) securing said lock to said second end of said cylindrical sleeve or to the second end of said rod, thereby sealing said pouch and enclosing said material therein.

10. The method of claim 9, wherein:

(a) the cap or ring comprises an elliptical cross-section having two protrusions on inner walls thereof in the area of the endpoints of the minor axis of the elliptical cross-section, said protrusions cooperating with said slots or apertures; and (b) said step of securing said lock comprises attaching said cap or ring to said end portion proximate the second open end of said cylindrical sleeve (12).

11. The method of claim 9, said step of folding said pouch so that said mouth of said pouch or said channel acts as a hanger for said pouch.

12. A method for re-opening the closed pouch of claim 9 comprising the steps of (a) pressing on two opposite areas at the exterior of the wall of said cap that are at right angles to said protrusions, thereby moving the protrusions of said cap axially away from said apertures; (b) removing said cap from said cylindrical sleeve; and (c) sliding said closure from said pouch, thereby allowing said material to be removed from said pouch.

13. A closure for a pouch comprising:

(a) a cylindrical sleeve having a first open end and a second open end;

(b) a longitudinal slit in said cylindrical sleeve having a close end proximate to said first open end of said cylindrical sleeve and an open end at said second open end of said cylindrical sleeve;

(c) a rod adapted to be arranged concentrically within said cylindrical sleeve having a first rod end and a second rod end, said first rod end being adapted to engage with said first open end of said cylindrical sleeve; and (d) a removable lock comprising a ring or cap proximate to and removably engaged with said second rod end of the rod, and locked in a child-proof manner, and blocking said open end of said longitudinal slit.

14. The closure of claim 13, wherein said cylindrical sleeve and said rod comprise a unitary body.

15. The closure of claim 14, wherein said cylindrical sleeve and said rod comprise separate parts that have been permanently interconnected to form said unitary body.

16. The closure of claim 13, wherein said rod is at least as long as said cylindrical sleeve.

17. The closure of claim 13, wherein the-first rod end is broadened compared to the rest of said rod, thereby stopping the movement of said rod in the direction of said second open end of said cylindrical sleeve when said first rod end engages said first open end of said cylindrical sleeve.

18. The closure of claim 13, wherein said rod has a cross-section that is selected from the group consisting of circular, square, triangular and n-angled polygons, wherein n may be an integer greater than or equal to 5, and wherein the walls of said rod are flat or cambered between the angles of said polygon.

19. The closure of claim 13, wherein the maximum outer diameter of said rod is from about 1 to about 30 mm.

20. The closure of claim 13, wherein said closure further comprises a hanger portion connected to or forming one part with said cylindrical sleeve.

* * * * *